United States Patent [19]

Francik et al.

[11] Patent Number: 5,067,295

[45] Date of Patent: Nov. 26, 1991

[54] 45 DEGREE BLOCK

[75] Inventors: Charles A. Francik, Murrysville; Harry A. Fleming, Jr., Smethport, both of Pa.; Donald E. Hock, Olean, N.Y.

[73] Assignee: Pittsburgh Corning Corporation, Pittsburgh, Pa.

[21] Appl. No.: 584,534

[22] Filed: Sep. 18, 1990

[51] Int. Cl.[5] ..... E04B 5/46

[52] U.S. Cl. ..... 52/306; 52/308; 52/609

[58] Field of Search ..... 52/306, 307, 308, 608, 52/609

[56] References Cited

U.S. PATENT DOCUMENTS

| | | | |
|---|---|---|---|
| D. 85,320 | 10/1931 | Bowman . | |
| D. 109,025 | 3/1938 | Perkins . | |
| D. 114,086 | 4/1939 | Lockart . | |
| D. 193,392 | 8/1962 | Kingsbury | D18/2 |
| D. 196,971 | 11/1963 | Virkkala | D18/2 |
| D. 198,626 | 7/1964 | Lockart et al. | D18/2 |
| D. 210,372 | 3/1968 | Behnk et al. | D18/2 |
| D. 210,373 | 3/1968 | Behnk et al. | D18/2 |
| D. 217,924 | 6/1970 | Hagen et al. | D48/16 |
| D. 241,429 | 9/1976 | Michaelis | D25/72 |
| D. 293,477 | 12/1987 | Pirosko et al. | D25/108 |
| 250,635 | 12/1881 | McLean . | |
| 298,418 | 5/1984 | Shaw . | |
| 402,073 | 4/1989 | Falconnier . | |
| 758,973 | 5/1904 | Kaye . | |
| 827,464 | 7/1906 | Pedrick . | |
| 1,425,102 | 8/1922 | Keppler . | |
| 1,855,987 | 4/1932 | Rammer . | |
| 1,994,387 | 3/1935 | Despret | 72/41 |
| 2,086,185 | 7/1937 | Keaney | 52/306 |
| 2,110,885 | 3/1938 | Lytle | 72/41 |
| 2,110,900 | 3/1938 | Zimmerman et al. | 72/41 |
| 2,115,264 | 4/1938 | Henderson | 72/41 |
| 2,115,513 | 4/1938 | Bauer | 72/41 |
| 2,226,220 | 12/1940 | Cox | 72/41 |
| 2,306,320 | 12/1942 | Rapp | 94/28 |
| 2,322,591 | 6/1943 | Rapp | 88/60 |
| 2,333,723 | 11/1943 | Jordan | 72/37 |
| 2,355,262 | 8/1944 | Blau | 88/59 |
| 2,724,260 | 11/1955 | D'Eustachio | 72/35 |
| 2,975,853 | 3/1961 | Friend | 181/33 |
| 3,396,504 | 8/1968 | DeOliveira | 52/575 |
| 3,714,816 | 8/1955 | Pennell | 72/41 |
| 3,798,861 | 3/1974 | Weiss | 52/306 |
| 4,023,319 | 5/1977 | Kurata | 52/308 |
| 4,572,699 | 2/1986 | Rinninger | 404/42 |
| 4,636,413 | 1/1987 | Wittmann et al. | 52/306 X |
| 4,648,226 | 3/1987 | Manon | 52/308 |
| 4,651,486 | 3/1987 | Erickson | 52/306 |
| 4,753,622 | 6/1988 | Nakama | 446/85 |

FOREIGN PATENT DOCUMENTS

| | | |
|---|---|---|
| 567594 | 8/1960 | Belgium . |
| 848079 | 10/1939 | France . |
| 470835 | 11/1935 | United Kingdom . |

OTHER PUBLICATIONS

"PC Glass Block Panels, Walls, Exterior and Interior Application" published by Pittsburgh Corning Corporation in Dec., 1983.

"Glass Block by Pittsburgh Corning Exterior and Interior Applications" published by Pittsburgh Corning Corporation in Mar., 1978.

*Primary Examiner*—Richard E. Chilcot, Jr.

*Assistant Examiner*—Linda J. Watson

*Attorney, Agent, or Firm*—Stanley J. Price, Jr.

[57] ABSTRACT

A translucent block includes a pair of parallel upper and lower surfaces each having a generally pentagonal shape. There are a pair of generally rectangular, nonparallel side faces whose planes intersect to form a dihedral angle at 45°. A generally rectangular first opposing end wall is joined to the upper and lower surfaces and is perpendicular therewith, and is joined to the side faces proximal to the vertex of the 45° dihedral angle. A second opposing end wall is formed of two equal sections joined at an obtuse angle to each other. The vertex of the obtuse angle points away from the first end wall, and the sections of the second end wall are perpendicular to and are joined to the upper and lower surfaces of the block and are joined to the nonparallel side surfaces of the block distal from the 45° dihedral angle. The translucent block can be joined to similar translucent blocks and/or different translucent blocks to form a wide variety of wall structures of 45° angles or combinations thereof, and into a column sturcture. There is included methods of forming the wall structures and a method of forming a column structure.

17 Claims, 5 Drawing Sheets

45 DEGREE BLOCK

BACKGROUND OF THE INVENTION

1. Field Of The Invention

This invention relates to a translucent block and, more particularly, to a translucent block having a 45° dihedral angle formed by the projected planes of the side faces of the translucent block which can be utilized with similar translucent blocks and blocks of other shapes to provide various column and wall structures. The invention also includes the method of forming such column and wall structures.

2. Description Of The Prior Art

The use of translucent block, such as glass block, for exterior and interior applications is well known. Using glass block for various wall structures offers various aesthetic and design features, as well as providing various functional characteristics and advantages over other materials which may be used for similar purposes. For example, glass block structures promote energy conservation through their insulating capability to reduce heat gain or loss and provide thermal efficiencies for energy conservation. Additionally, glass block structures can control light transmission and glare, as well as reduce surface condensation, and draft and noise transmission. Because of their construction, glass block structures offer security advantages as well as maintaining light transmission therethrough. Further, glass block structures have the added advantage of ease of maintenance and installation.

U.S. Pat. No. Des. 114,085 discloses a corner block configuration having arcuate walls and appears to be formed of two halves having different configurations. One of the halves also has raised linear portions as an exterior design. The angle formed by the side walls appears to be a wider angle than 45°.

U.S. Pat. No. 2,086,185 discloses an integrally blown hollow glass block of regular hexagonal form. This prior art patent also discloses a masonry structure or wall including the hexagonal glass block positioned with mortar in a configuration wherein the hexagonal sides would combine to form the exterior surface of the structure or wall.

U.S. Pat. No. 2,281,524 discloses glass building blocks molded in a single piece and using a socket in socket construction. The disclosed glass block is formed at a 90° angle and has an open bottom.

U S. Pat. No. 4,537,001 discloses building elements with sides that have mathematical relations to each other U.S. Pat. No. 4,636,413 discloses a glass block that has at least approximately the shape of a sector of a circular cylinder, the side faces forming the sector of the circular cylinder and having an axis defined by the side faces of the cylinder including an angle of 45° or 90°. The end wall opposite the 45° or 90° axis is an arcuate end wall.

U.S. Pat. No. 4,651,486 discloses a translucent block having a generally irregular hexagonal configuration which can be utilized with similar translucent blocks and blocks of other shapes to provide various column and wall structures. The method of forming such column and wall structures is also disclosed.

U.S. Pat. No. 4,719,735 discloses a translucent end cap for use with a translucent glass block. The end cap has top and bottom surfaces parallel to each other. The side surfaces are perpendicular to and joined to the top and bottom surfaces. A raised rear surface portion extends from the side surface to form a protrusion so that the end cap may be secured to an abutting side surface of a translucent glass block.

U.S. Pat. No. 4,852,321 discloses a translucent end block which may be secured to an exposed top or side abutting surface of a translucent block to provide a wall structure in which the exposed top or side surface of the wall structure does not require wood or similar coverings to form useable top or side surfaces.

Accordingly, there remains a need for a translucent block configuration which can be employed as a corner piece for joining translucent block walls at an angle of 45° or larger angles by using a plurality of such blocks for corner sections or can be independently employed to form walls and columns of different configurations.

SUMMARY OF THE INVENTION

In accordance with the present invention, there is provided a translucent block having a pair of parallel upper and lower surfaces with a generally pentagonal shape. The block has a pair of generally rectangular, opposing side faces which are nonparallel with each other and have a first preselected height and a first preselected width. The extension of the planes of the side faces form a 45° dihedral angle. The side faces are joined to the upper and lower surfaces and are perpendicular therewith. The block has a first generally rectangular, opposing end wall with the first preselected height and a second preselected width. The first opposing end wall is joined to the upper and lower surfaces and the side faces proximal to the dihedral angle formed by the projected planes of the side faces. The first opposing end wall is in two generally rectangular sections bisected along the longitudinal axis by the bead formed in fusing the halves of the block together. The first opposing end wall is perpendicular to the upper and lower surfaces. A second end wall is opposite the first end wall and is in two generally rectangular equal sections at an obtuse angle to each other with the vertex formed by the angle pointing away from the first end wall. The second end wall sections are joined to the upper and lower surfaces and the second end wall sections are perpendicular therewith, and are joined to the side faces. The second end wall has the same first preselected height and a third preselected width.

Further, in accordance with the present invention, there is provided a translucent block wall structure including a first translucent block having a pair of parallel upper and lower surfaces. The upper and lower surfaces each have a generally pentagonal shape. The block has a pair of generally rectangular, opposing side faces which are nonparallel with each other. The extended planes from the side faces form a 45° dihedral angle. The side faces have a first preselected height and a first preselected width. The side faces are perpendicular to and joined to the upper and lower surfaces. A first generally rectangular end wall is perpendicular to and joined to the upper and lower surfaces. The first end wall is joined to the side faces proximal to the dihedral angle formed by the projected planes of the side faces. The first generally rectangular end wall is bisected along the longitudinal axis, by the bead formed in fusing the halves of the block together, medially to form two generally rectangular equal sections. A second opposing end wall is formed of two generally rectangular equal sections that are joined at an obtuse angle to each other and are joined to the top and bottom surfaces. The end wall sections are perpendicular to the top and bottom surfaces and are also joined to the side faces. A second translucent block includes a pair of parallel top and bottom surfaces of identical shape and generally rectangular side surfaces having the first preselected height. The side surfaces are perpendicular to and joined to the top and bottom surfaces of the second translucent block. One of the sides of the first block is joined in abutting relationship with the generally rectangular side surface of the second block to form a translucent block wall structure. The abutting rectangular side surface of the second translucent block has a generally corresponding width which corresponds to the first preselected width of the side faces of the first block.

The present invention also provides a method of forming such a translucent block wall structure.

Also in accordance with the present invention, there is provided a translucent block column structure including a translucent block having a pair of parallel upper and lower surfaces each having a generally pentagonal shape. A pair of generally rectangular, opposing side faces are nonparallel with each other. The projected planes from the opposing side faces form a 45° dihedral angle. The side faces have a first preselected height and a first preselected width, and are joined to the upper and lower surfaces. A first generally rectangular end wall has the first preselected height and a second preselected width, and is perpendicular and joined to the upper and lower surfaces. The first end wall is joined to the side faces proximal to the dihedral angle formed by the projected planes of the faces. The first end wall is bisected medially along its longitudinal axis, into two equal sections. A second end wall is formed of two generally rectangular equal sections, having the first preselected height and a third preselected width, which are angled relative to each other to form an obtuse angle with the vertex formed by the angle pointing away from the first end wall. The sections of the second end wall are joined to the upper and lower surfaces and are perpendicular therewith. The sections of the second end wall are joined to the side faces. There are a plurality of translucent blocks of the same configuration. Each of the side faces of the translucent block is joined in an abutting relationship with the side face of the first translucent block. The translucent blocks are joined in an encircling array to form a horizontal layer of the translucent block column structure.

There is also provided a method of forming such a translucent block column structure.

Accordingly, an object of the present invention is to provide a generally pentagonal translucent block having a 45° dihedral angle formed by the projected planes of the side faces of the block to provide functionality and versatility in translucent block wall and column structures.

An additional object of the present invention is to provide a translucent block which is capable of providing increased functional capabilities and uses for translucent blocks.

A further object of the present invention is to provide a method for forming a wide variety of wall and column structures by the use of at least some of the translucent blocks with the 45° configuration.

These and other objects of the present invention will be more completely disclosed and described in the following specification, the accompanying drawings, and the appended claims.

DESCRIPTION OF THE PREFERRED EMBODIMENTS

Figure 1:
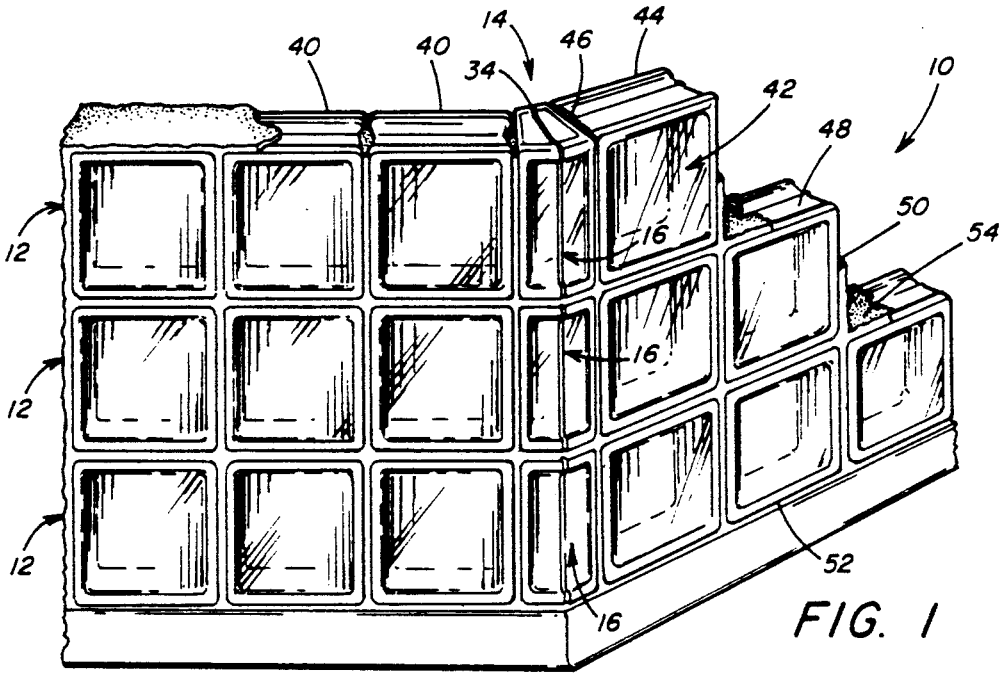
FIG. 1 is a perspective view of a portion of a translucent block wall structure having an integrally joined corner section including translucent blocks of the present invention, the extended planes of the side faces of each block in the corner forming a dihedral angle at 45°, and forming a curve in the wall of 45°.
Figure 5:
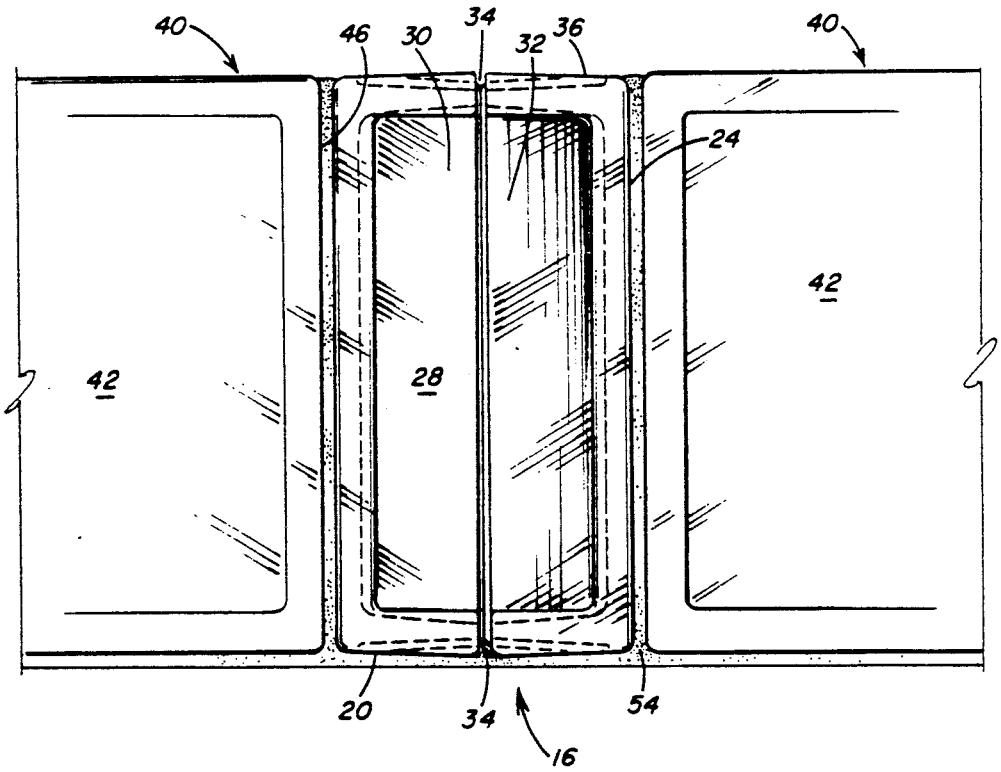
FIG. 5 is a fragmentary, front view showing the corner section of FIG. 1 including the preferred translucent block with the extended planes of its side faces forming a 45° dihedral angle according to the present invention.
Figure 6:
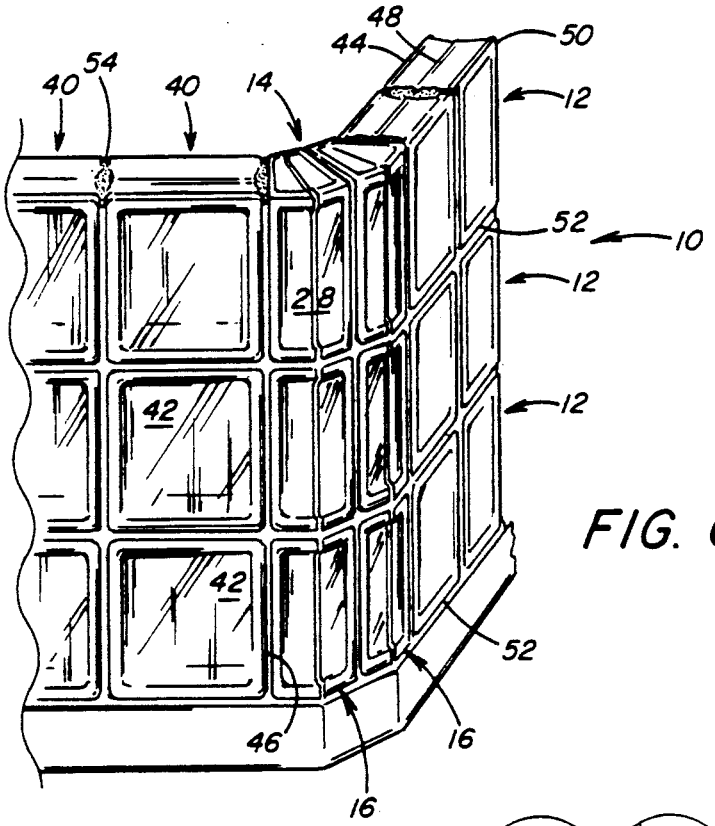
FIG. 6 is a perspective view of a portion of a translucent block wall structure have an integrally joined corner section including two translucent blocks of the present invention in each layer, the extended planes of the side faces or each block forming a dihedral angle at 45°, and forming a curve in the wall of 90°.

Referring to the drawings, particularly to FIGS. 1 and 6 there is illustrated a translucent block wall structure 10, having at least one layer of translucent block. The layers of translucent block are generally designated by the numeral 12. The translucent block wall structure 10 includes a corner section 14 with conventional, straight translucent block wall sections integrally joined therewith. The corner section 14 is illustrated in greater detail in FIGS. 4, 5, 7, 8, and 9.

To form the corner section 14, the translucent block wall structure 10 includes a plurality of translucent blocks 16 the extended planes of the side faces 22, 24 of which form a dihedral angle (a) at 45 degrees. One of the blocks 16 is illustrated in greater detail in FIGS. 2 and 3. Block 16 has a pair of parallel upper and lower surfaces 18 and 20 each having a generally pentagonal shape and generally rectangular side faces 22 and 24 which are nonparallel, the projected planes of side faces 22 and 24 intersecting at a 45° dihedral angle as shown as projected angle (a) in FIG. 4. This configuration provides the desired features which allow the block 16 to be used in numerous ways to provide walls and columns of translucent blocks.

Figure 2:
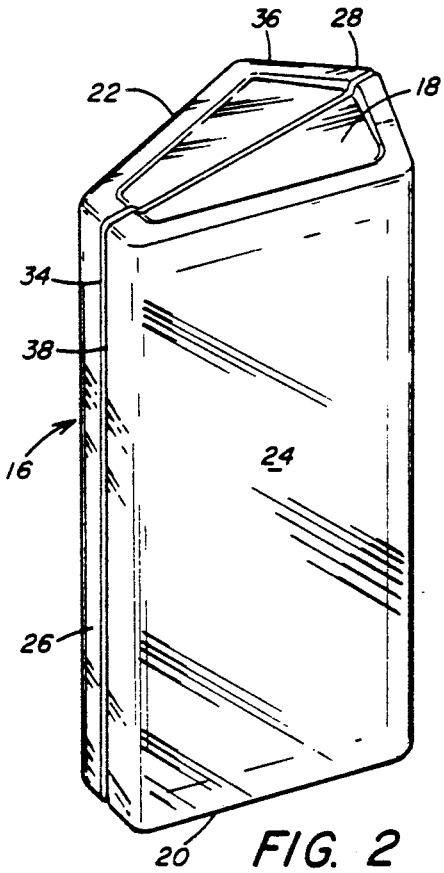
FIG. 2 is a perspective view of a translucent block of the present invention, the extended planes of the side faces of which form a dihedral angle at 45°.

The preferred translucent block 16 has an upper surface 18 and a lower surface 20 of a generally pentagonal configuration which are identical. The upper surface 18 is shown in FIGS. 2, 3, and 4, 7, 8, and 9 and the lower surface 20 is indicated in FIGS. 2, 3, 5 although not specifically visible therein.

Figure 4:
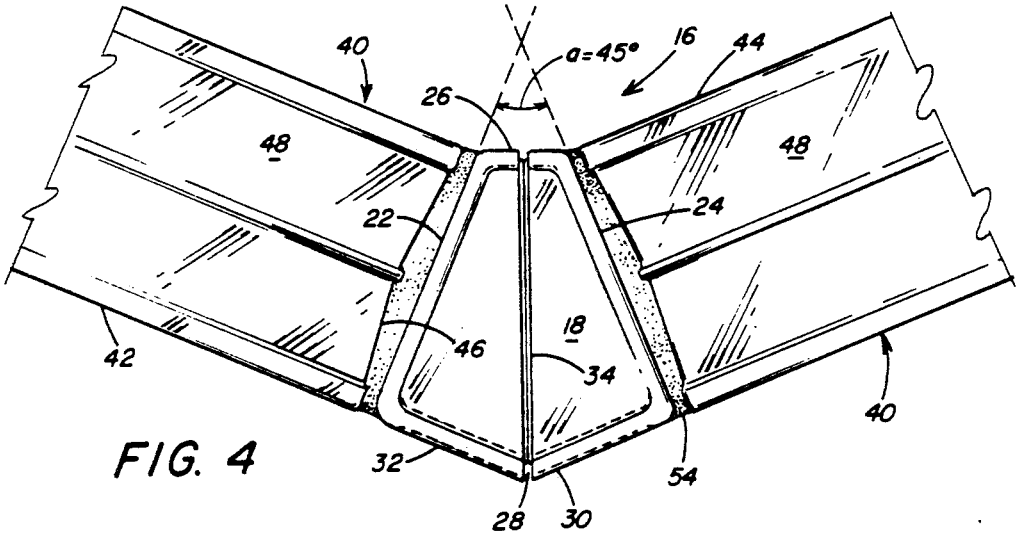
FIG. 4 is a fragmentary, top plan view showing the corner section in FIG. 1 including the preferred translucent block with the extended, planes of its side faces forming a 45° dihedral angle according to the present invention.

The block 16 also has two side faces 22 and 24 of a generally rectangular configuration of a first preselected height and a first preselected width and forming the side faces 22, 24 of the block 16. Side faces 22 and 24 are nonparallel with each other, the projected planes of the side faces 22 and 24 intersect at a 45 degree dihedral angle (a) as shown in FIG. 4, side faces 22, 24 are integrally joined to upper surface 18 and lower surface 20 of block 16 and side faces 22, 24 are perpendicular to the upper and lower surfaces 18, 20.

The preferred block 16 also includes a first end wall 26, and a second end wall 28; the end walls 26 and 28 are of the same first preselected height as the side faces 22 and 24 and have a second and third preselected width. As can best be seen in FIG. 2 first end wall 26 is generally rectangular and is perpendicular to and joined to the upper surface 18 and the lower surface 20 and is joined to side faces 22, 24. The first end wall 26 is proximal to the 45 degree dihedral angle (a) formed by the projected planes of side faces 22 and 24. The first generally rectangular end wall 26 is bisected into two equal generally rectangular sections along its longitudinal axis, by the bead 38 formed in fusing the halves of the block 16 together.

Figure 3:
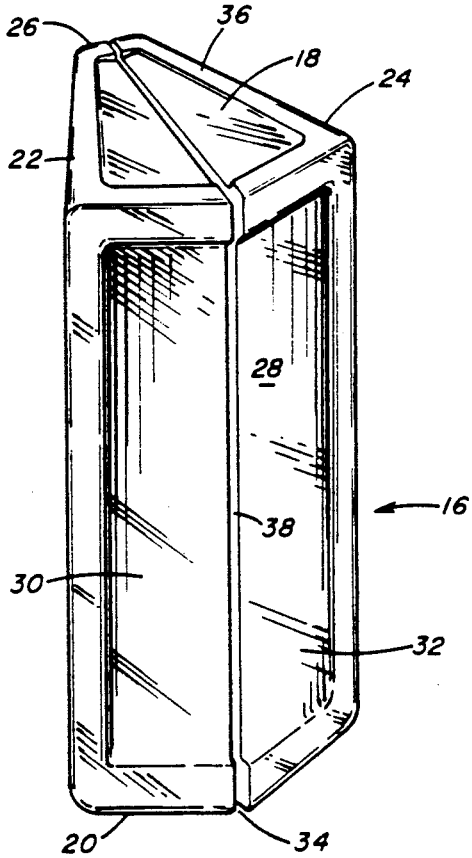
FIG. 3 is another perspective view of a translucent block of the present invention, the extended planes of the side faces of which form a dihedral angle at 45°.

The second end wall 28 is in two equal sections 30 and 32 as can best be seen in FIGS. 3 and 5. Each section 30 and 32 of second end wall 28 has the same first preselected height as side faces 22 and 24 and first end wall 26. Each section 30 and 32 of second end wall 28 forms an obtuse angle, the vertex of which is directed away from the first end wall 26. The equal sections 30, 32 of second end wall 28 are defined medially on the longitudinal axis of end wall 28 by the bead 38 formed in fusing the halves of block 16 together.

Additionally, the outer periphery of the side faces 22 and 24 and the upper and lower surfaces 18 and 20 preferrably include a raised portion 36 to provide a slightly inward displacement of a substantial portion of the side faces 22, 24 and upper and lower surfaces 18, 20, to permit the joining of any side face 22, 24, or upper surface 18 or lower surface 20 of block 16 with other identical or different blocks in a translucent block structure.

Block 16 can be formed from any suitable translucent material such as glass, and can be formed by any conventional glass block molding process known in the art. Block 16 is desirably a hollow glass block and is preferrably formed by pressing two halves of block together at appropriate temperature and pressure conditions using known conventional processes and apparatus. Various design configurations can be formed on the surfaces of the glass block 16.

Accordingly, as will be further discussed hereinbelow, it is significant that second end wall 28 provides an exterior decorative appearance for the block 16, as generally indicated in FIGS. 3 and 5, which significantly contributes to its overall aesthetic value.

The location of the fusion of the two pressed halves of block forming the unitary block 16 is indicated at numeral 38 in FIGS. 2 and 3. Each of the halves of block 16 are identical and include one of the side faces 22, 24, one half of first end wall 26, one half of second end wall 28 which is either section 30 or 32, one half of upper surface 18 and one half of lower surface 20. The preferred block 16 also includes a channel-like spacing 34 located medially along the longitudinal axes of first end wall 26 and second end wall 28.

It should be clear from the figures that the preferred block 16 consists of the same function and purpose generally provided by the rounded and right angled corner blocks discussed in the prior art hereinabove. However, since the two halves of block 16 are identical, only one mold must be provided to basically form the identical half while at least two different molds should be required for the two different halves of the prior art corner blocks.

The translucent block wall structure 10 also includes a plurality of translucent blocks 40 of a generally rectangular configuration. Blocks 40 can be selected from any number of conventional, generally rectangular translucent block configurations. For example, the blocks 40 have a front face 42 and a rear face 44 which are generally rectangular. The front face 42 is shown in FIGS. 1 and 6 and the rear face 44 is indicated in FIGS. 1 and 6. The faces 42, 44 are substantially identical in appearance.

The blocks 40 also have four abutting surfaces 46, 48, 50 and 52 which are generally rectangular as indicated in FIGS. 1 and 6. Because the particular rectangular faces 42, 44 of the block 40 shown in the figures preferrably form a square, the abutting surfaces 46, 48, 50, 52 are substantially similar to each other in appearance and configuration. However, because of the method of forming the block 40, in a normal use of any abutting surface to join any other abutting surface, the appearance of the abutting surface is not particularly governed by aesthetic consideration as might the appearance of the faces 42, 44. The blocks 40 would preferrably be formed in a similar manner as the blocks 16 and the molding of separate halves thereof would again normally include a decorative design on the interior surfaces of the faces 42, 44 but not on those associated with the abutting surfaces 46, 48, 50, 52.

Specifically, in the translucent block wall structure 10, the abutting surfaces 46, 48, 50, 52 of blocks 40 are fixedly joined to adjacent abutting surfaces of adjacent block 40 as indicated in FIGS. 1 and 6. For example, the abutting surfaces can be joined by a suitable bonding material 54, such as a conventional cementitious material or a suitable adhesive material.

Referring to FIGS. 4, 5, 7, 8, and 9, there is illustrated a corner section 14 of translucent block in a layer 12 of the translucent block wall structure 10. A block 16 is joined by a suitable bonding material 54 such as mortar, at side faces 22 and 24 to abutting surfaces 46 of adjacent blocks 40. As mentioned hereinabove, to be properly employed to form the corner section 14, the heights and widths of the side faces 22, 24 and the abutting surfaces 46, 48, 50 and 52 should be substantially the same, or the sum of a combination of the heights and widths of side faces 22, 24 and abutting surfaces 46, 48, 50, 52 should be substantially the same.

Figure 7:
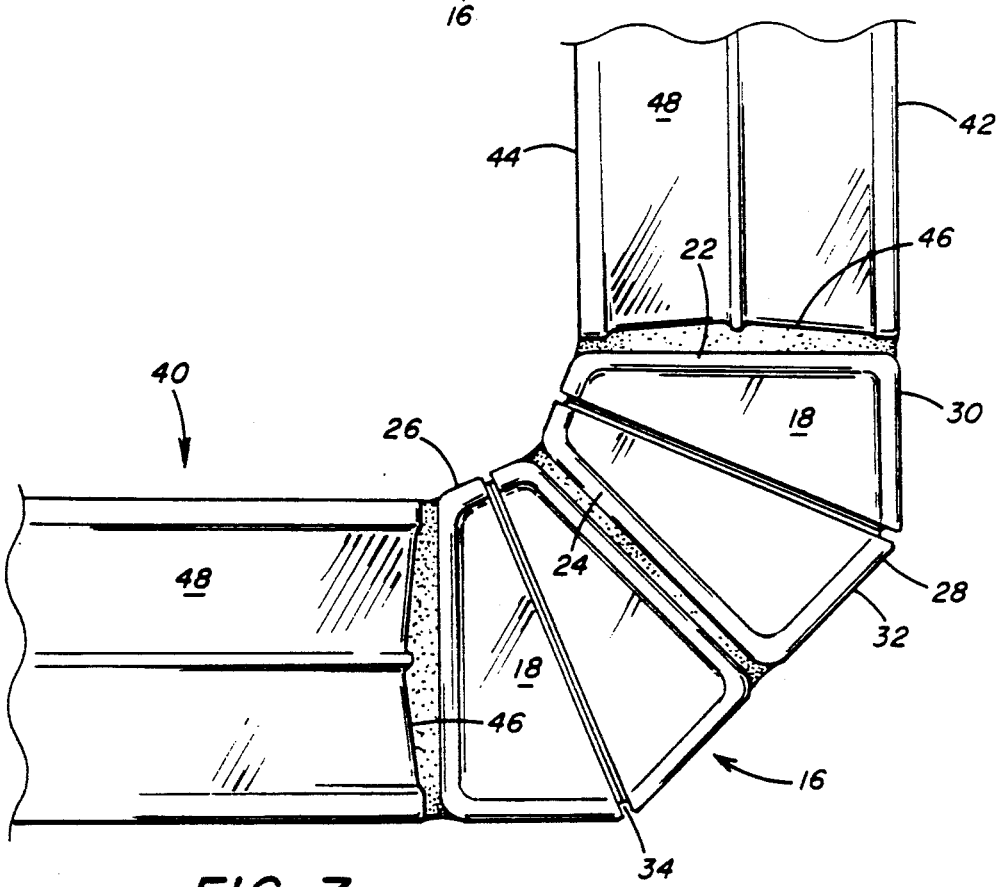
FIG. 7 is a fragmentary, top plan view of FIG. 6 showing a corner section including two of the preferred translucent blocks with the extended planes of each of their side faces forming a 45° dihedral angle according to the present invention, and forming a 90° curve in the wall.
Figure 8:
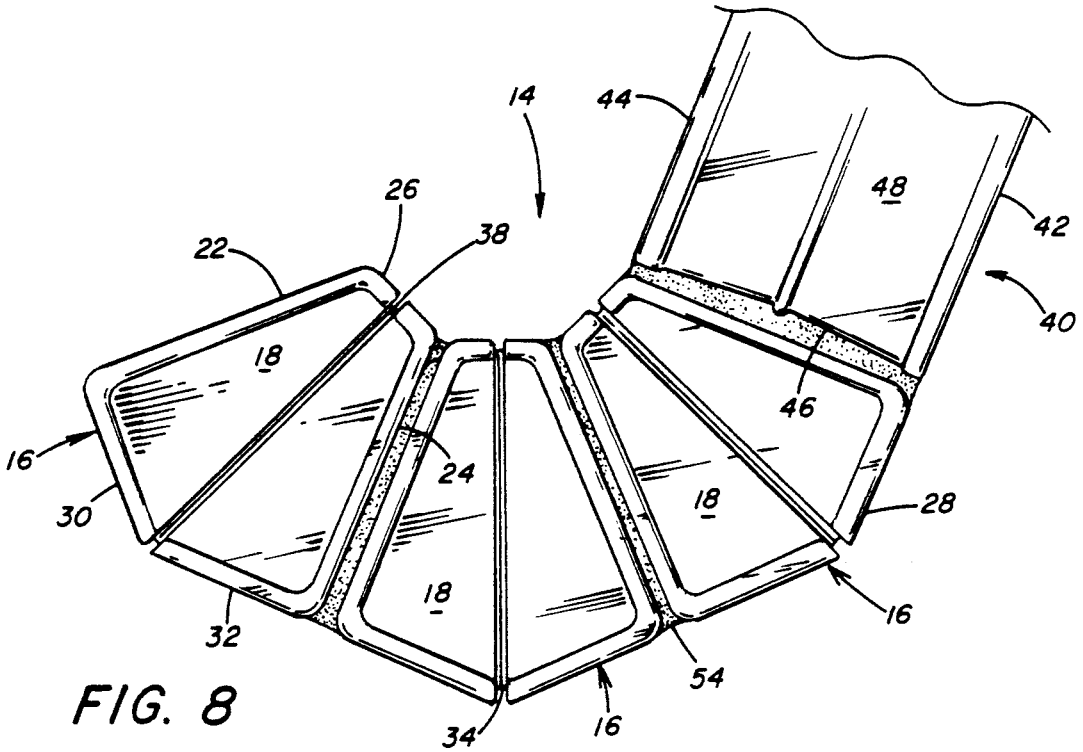
FIG. 8 is a fragmentary, top plan view showing a corner section including three of the preferred translucent blocks with the extended planes of each of their side faces forming a 45° dihedral angle according to the present invention, and forming a 135° curve in the wall.
Figure 9:
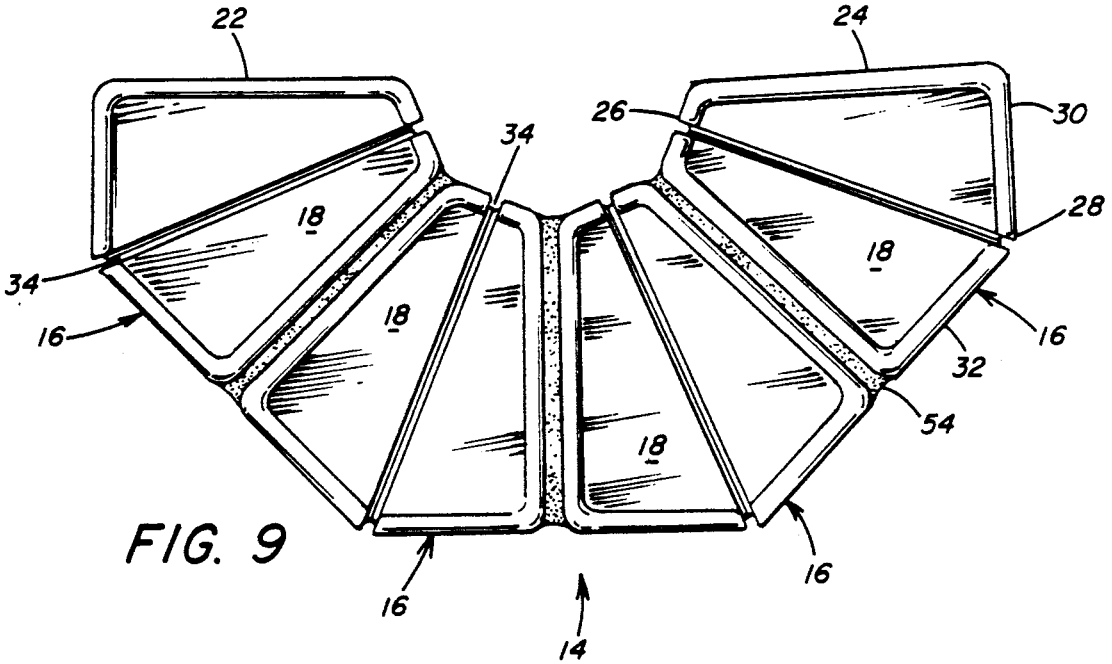
FIG. 9 is a fragmentary, top plan view showing a corner section including four of the preferred translucent blocks with the extended planes of each of their side faces forming a 45° dihedral angle according to the present invention, and forming a 180° curve in the wall.

While FIG. 4 illustrates the cement or adhesive bonding 54 of the side faces 22, 24 of block 16 to abutting surfaces 46 of two blocks 40 to form a transparent block wall 10 with a 45 degree curve, corner section 14 of translucent block 16, according to the invention, can be formed by joining two blocks 16 to form a 90° curve in a transparent block wall 10 as illustrated in FIG. 7. As shown in FIG. 8, three blocks 16 maybe joined in the corner section 14 to make a transparent block wall structure 10 having a 135° curve. As shown in FIG. 9, four blocks 16 may be joined as a corner section 14 to make a transparent block wall structure 10 having a 180° curve. Consequently the block 16 may be utilized to form a transparent block wall structure 10 having a desired curve of 45°, 90°, 135°, 180°, or combinations thereof.

It should now be clear that one of the primary features of the present invention includes a configuration having nonparallel sides faces the projected planes of which form a dihedral 45° angle capable of being used as a corner section 14 in a transparent block wall structure 10 to make a curve of 45° or any other combination of 45° to provide flexibility in the construction of transparent block wall structures 10.

Figure 10:
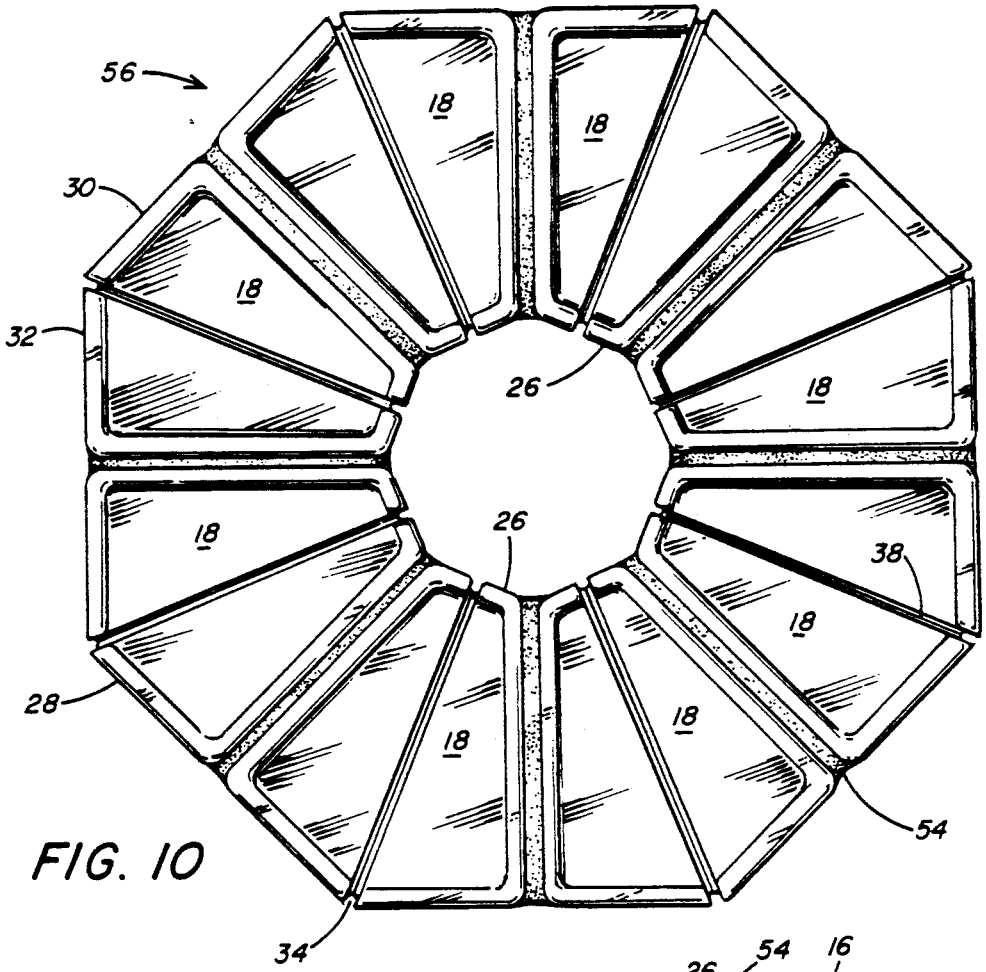
FIG. 10 is a schematic top plan view of a layer of a translucent block column structure including the preferred translucent blocks with the extended planes of the side faces of each block forming 45° dihedral angles according to the present invention.
Figure 11:
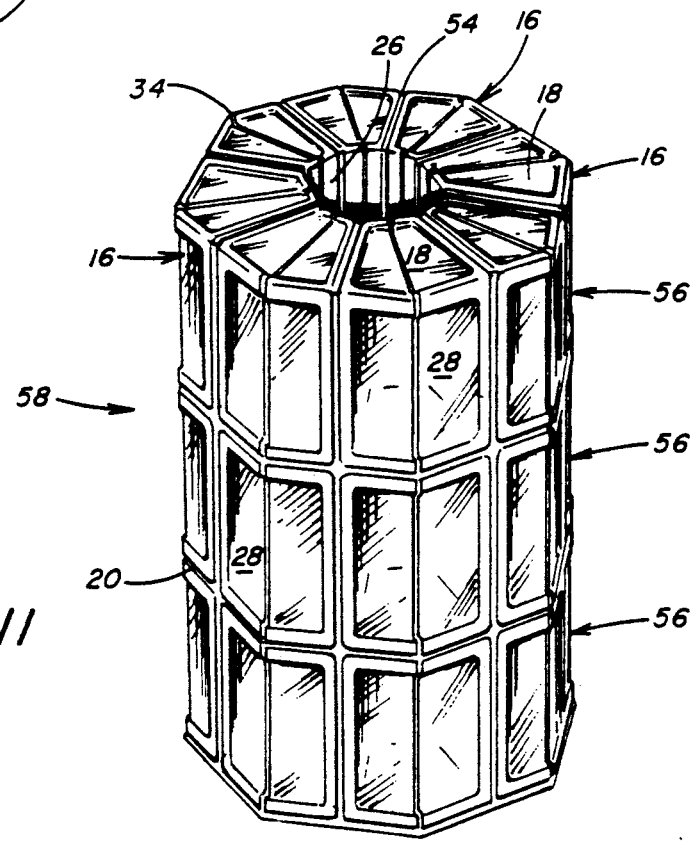
FIG. 11 is a perspective view of a translucent block column structure including the preferred translucent blocks with the extended planes of the side faces of each block forming 45° dihedral angles according to the present invention.

Although the descriptions provided hereinabove are primarily directed to a single layer 12 of blocks 16 and/or blocks 40, it should be clear that any number of types of wall and corner configurations can be provided by employing multiple layers 12 of such blocks 16 in a conventional manner when constructing a wall. Referring to FIG. 10, a layer of translucent block 56 in a column structure 58 is illustrated from the top in schematic form. The translucent block column structure of the present invention may include any number of layers 56 as may be required to form a column 58, illustrated in FIG. 11. In order to provide the mutiple layers 56 of the column structure 58 as described, the upper surfaces 18 may be joined to the lower surfaces 20 of corresponding blocks 16 with a similar bonding material 54 in order to add sufficient integrity to the columnm structure 58.

In summary, the present invention provides a generally rectangular translucent block, such as a glass block, the nonparallel side faces of which have projected planes forming a dihedral 45° angle, and translucent block wall structures and methods utilizing a generally pentagonal translucent block with nonparallel side faces, the projected planes of the side faces forming a dihedral 45° angle, to enhance the uses of translucent block and translucent block structures. Thus, the present invention provides additional functional abilities and versatility for translucent blocks.

According to the provisions of the Patent Statute, we have explained the principal, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A translucent block comprising:

a block having a pair of parallel upper and lower surfaces each having a generally pentagonal shape, said block having a pair of generally rectangular opposing side faces which are nonparallel, said side faces having a first preselected height and a first preselected width, said side faces being joined to said upper and said lower surfaces and being perpendicular therewith, said pair of nonparallel side faces having planes formed by the projection of an imaginary line parallel to each said nonparallel side face and the intersection of said imaginary lines forming a 45° dihedral angle, a generally rectangular, first opposing end wall having said first preselected height and a second preselected width, said first end wall being perpendicular to and joined to said upper and said lower surfaces, said first opposing end wall being joined to said side faces proximal to said 45° dihedral angle formed by said projected planes of said side faces, a second opposing end wall having said first preselected height and a third preselected width, said second opposing end wall being joined to said upper and said lower surfaces and being perpendicular therewith, said second opposing end wall being joined to said side faces distal from said 45° dihedral angle formed by said projected planes of said side faces, said second opposing end wall being formed of two generally rectangular equal portions at an obtuse angle to each other, the vertex of said obtuse angle formed by the juncture of said portions pointing outwardly and away from said dihedral angle, said block being formed of two identical halves, each said half including one of said pair of side faces, an adjoining half of said first end wall, an adjoining half of said second end wall and an adjoining half of said upper and said lower surfaces.

2. The translucent block as set forth in claim 1, wherein said first opposing end wall and said second opposing end wall having channel-like spacing at the juncture of said two identical halves.

3. The translucent block as set forth in claim 1, wherein each of said side faces being arranged to be joined in abutting relationship with an abutting rectangular surface of another block.

4. The translucent block as set forth in claim 1, wherein each of said side faces being arranged to be joined in abutting relationship with an abutting rectangular surface of another block with said abutting rectangular surface having substantially said first preselected height and a generally corresponding preselected width.

5. The translucent block as set forth in claim 1, wherein each of said upper surface and said lower surface of said block being arranged to be joined in abutting relationship with an abutting surface of another block with said abutting surface having a corresponding generally pentagonal surface.

6. A translucent block wall structure comprising, a first block having, a pair of parallel upper and lower surfaces each having a generally pentagonal shape, said block having a pair of generally rectangular opposing side faces which are nonparallel, said side faces having a first preselected height and a first preselected width, said side faces being joined to said upper and said lower surfaces and being perpendicular therewith, said pair of nonparallel side faces having planes formed by the projection of an imaginary line parallel to each said nonparallel side face and the intersection of said imaginary lines forming a 45° dihedral angle, a generally rectangular first opposing end wall having said first preselected height and a second preselected width, said first end wall being perpendicular to and joined to said upper and said lower surfaces, said first opposing end wall being joined to said side faces proximal to said 45° dihedral angle formed by said projected planes of said side faces, a planar second opposing end wall having said first preselected height and a third preselected width, said second opposing end wall being perpendicular to and joined to said upper and said lower surfaces, said second opposing end wall being joined to aid side faces distal from said 45° dihedral angle formed by said projected planes of said side faces, said planar second opposing end wall being formed of two equal generally rectangular portions joined to each other at an obtuse angle, the vertex of said obtuse angle formed by the juncture of said portions pointing outwardly and away from said dihedral angle, said block being formed of two identical halves, each said half including one of said pair of side faces, an adjoining half of said first end wall, an adjoining half of said second end wall and an adjoining half of said upper and said lower surfaces, a second translucent block including a pair of parallel top and bottom surfaces of identical shape and a generally rectangular abutting surface and being perpendicular and joined to said top and said bottom surfaces, each of said side faces of said first block being joined in abutting relationship with said abutting rectangular surface of said second block to form at least a portion of a horizontal layer of said translucent block structure.

7. The translucent block wall structure as set forth in claim 6, further including a plurality of said horizontal layers wherein said upper surface of each of said first blocks being joined to said lower surface of each adjacent said first block thereabove and said top surface of each of said second blocks being joined to said bottom surface of each adjacent said bottom block thereabove.

8. The translucent block wall structure as set forth in claim 6, wherein said top surface and said bottom surface of said second block each having a second generally pentagonal shape and nonparallel side faces, said projected planes of said side faces intersecting at a 45° dihedral angle.

9. The translucent block wall structure as set forth in claim 6, wherein said top surface and said bottom surface of said second block each having a generally rectangular shape.

10. The translucent block wall structure as set forth in claim 6, wherein said horizontal layer includes another of said side faces of said first block being joined in abutting relationship with another abutting rectangular surface of a third block.

11. The translucent block wall structure as set forth in claim 10, wherein said first and said second blocks are identical.

12. The translucent block wall structure as set forth in claim 10, wherein said first, said second, and said third blocks are identical.

13. A translucent block column structure comprising, a plurality of translucent blocks having, a plurality of parallel upper and lower surfaces each having a generally pentagonal shape, said block having a pair of generally rectangular opposing side faces which are nonparallel, said side faces having a first preselected height and a first preselected width, said side faces being joined to said upper and said lower surfaces and being perpendicular therewith, said pair of nonparallel side faces having planes formed by the projection of an imaginary line parallel to each said nonparallel side face and the intersection of said imaginary lines forming a 45° dihedral angle, a generally rectangular first opposing end wall having said first preselected height and a second preselected width, said first end wall being perpendicular to and joined to said upper and said lower surfaces and said first opposing end wall being joined to said side faces proximal to said 45° dihedral angle formed by said projected planes of said side faces, a planar second opposing end wall having said first preselected height and a third preselected width, and being joined to said upper and said lower surfaces and being perpendicular therewith, and said second opposing end wall being joined to said side faces distal from said 45° dihedral angle formed by said projected planes of said sides faces, said second opposing end wall formed of two generally rectangular portions joined at an obtuse angle to each other, the vertex of the obtuse angle formed by the juncture of said portions pointing outwardly and away from said dihedral angle, said block being formed of two identical halves, each said half including one of said side faces, an adjoining half of said first end wall, an adjoining half of said second end wall, an adjoining half of said upper and said lower surfaces, each of said blocks said generally rectangular opposing side faces being in abutting relationship with another of said generally rectangular opposing side faces of an adjacent block, all said blocks being arranged in an encircling array, said encircling array of blocks forming a horizontal layer of a column and said first opposing end walls of each said block defining the inner diameter of said column, said second opposing end walls of each said block in said encircling array defining the outside diameter of said column and said outside diameter having sixteen facets formed thereon.

14. The translucent column structure as set forth in claim 12, wherein said first opposing end wall and said second opposing end wall each having a channel-like spacing at the junction of said two identical halves.

15. The translucent column structure as set forth in claim 13, further including a plurality of said horizontal layers wherein said upper surface of each of said translucent blocks being joined to said lower surface of each adjacent translucent block thereabove and said upper surface of each said additional translucent blocks being respectively joined to said bottom surface of each corresponding adjacent said additional translucent block thereabove.

16. The translucent column structure as set forth in claim 13, further including a plurality of said horizontal layers wherein said upper surface of each of said translucent blocks is joined to said lower surface of each adjacent said translucent block thereabove and said upper surface of each of said additional translucent blocks being respectively joined to said bottom surface of each corresponding adjacent said additional translucent block thereabove.

17. The translucent column structure as set forth in claim 14, further including a plurality of said horizontal layers wherein said upper surface of each of said translucent blocks being joined to said lower surface of each adjacent said translucent block thereabove and said upper surface of each said additional translucent blocks being respectively joined to said bottom surface of each corresponding adjacent said additional translucent block thereabove.

* * * * *